US009551290B2

(12) United States Patent
Filippi et al.

(10) Patent No.: US 9,551,290 B2
(45) Date of Patent: Jan. 24, 2017

(54) FLUID INJECTOR FOR A COMBUSTION ENGINE

(71) Applicant: Continental Automotive GmbH, Hannover (DE)

(72) Inventors: Stefano Filippi, Castel' Anselmo Collesalvetti (IT); Mauro Grandi, Leghorn (IT); Francesco Lenzi, Leghorn (IT); Valerio Polidori, Leghorn (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 192 days.

(21) Appl. No.: 14/295,604

(22) Filed: Jun. 4, 2014

(65) Prior Publication Data

US 2014/0352667 A1 Dec. 4, 2014

(30) Foreign Application Priority Data

Jun. 4, 2013 (EP) ..... 13170450

(51) Int. Cl.
*F02D 41/00* (2006.01)
*F02D 41/30* (2006.01)
(Continued)

(52) U.S. Cl.
CPC ..... *F02D 41/30* (2013.01); *F02M 51/0682* (2013.01); *F02M 61/166* (2013.01);
(Continued)

(58) Field of Classification Search
CPC F02M 51/06; F02M 51/0671; F02M 51/0614; F02M 91/18; F02M 2200/9038
(Continued)

(56) References Cited

U.S. PATENT DOCUMENTS 3,814,598 A * 6/1974 Gabriel ..... B22F 3/14 419/19
4,245,789 A 1/1981 Gray ..... 239/585.2
(Continued)

FOREIGN PATENT DOCUMENTS

EP 2492488 A1 8/2012 ..... F02M 51/06
EP 2574768 A1 4/2013 ..... F02M 51/06

OTHER PUBLICATIONS

European Search Report, Application No. 13170450.4, 6 pages, Dec. 9, 2013.

*Primary Examiner* — Arthur O Hall
*Assistant Examiner* — Viet Le
(74) *Attorney, Agent, or Firm* — Slayden Grubert Beard PLLC

(57) ABSTRACT

A fluid injector for a combustion engine includes a central longitudinal axis, an injection valve housing with an injection valve cavity, a valve needle axially movable within the injection valve cavity, and an electromagnetic actuator unit that actuates the valve needle. The electromagnetic actuator unit includes a pole piece fixedly coupled to the injection valve housing and an armature axially movable within the injection valve cavity and operable to displace the valve needle. The pole piece has a first contact surface and the armature has a second contact surface which are directed opposite each other, wherein one of the two contact surfaces is designed to have a contact angle of less than 90° with a given fluid, and wherein the other of the two contact surfaces is designed to have a contact angle of at least 90° with the given fluid.

16 Claims, 2 Drawing Sheets

(51) Int. Cl.
*F02M 61/16* (2006.01)
*F02M 51/06* (2006.01)
*F02M 61/18* (2006.01)

(52) U.S. Cl.
CPC ..... *F02M 61/188* (2013.01); *F02M 2200/02* (2013.01); *F02M 2200/304* (2013.01); *F02M 2200/9038* (2013.01)

(58) Field of Classification Search
USPC ..... 239/584, 533.1–533.15; 251/129.15
See application file for complete search history.

(56) References Cited

U.S. PATENT DOCUMENTS

| | | | | |
|---|---|---|---|---|
| 5,732,888 | A * | 3/1998 | Maier | F02M 51/0614 239/585.1 |
| 2007/0012803 | A1 | 1/2007 | Shimizu et al. | 239/497 |
| 2007/0176716 | A1 | 8/2007 | Sugiyama | 335/78 |
| 2009/0159728 | A1 | 6/2009 | Suzuki et al. | 239/584 |
| 2010/0224706 | A1 | 9/2010 | Suzuki et al. | 239/584 |

* cited by examiner

FLUID INJECTOR FOR A COMBUSTION ENGINE

CROSS-REFERENCE TO RELATED APPLICATIONS

This application claims priority to EP Patent Application No. 13170450 filed Jun. 4, 2013. The contents of which are incorporated herein by reference in their entirety.

TECHNICAL FIELD

The invention relates to a fluid injector for a combustion engine.

BACKGROUND

Injectors are in widespread use, in particular for internal combustion engines, where they may be arranged in order to dose the fluid into an intake manifold of the internal combustion engine or directly into the combustion chamber of a cylinder of the internal combustion engine. These injectors ought to have a high reliability over their lifetime and a very exact injection volume.

SUMMARY

One embodiment provides a fluid injector for a combustion engine comprising: a central longitudinal axis, an injection valve housing with an injection valve cavity, a valve needle being axially movable within the injection valve cavity, an electromagnetic actuator unit being designed to actuate the valve needle, the electromagnetic actuator unit comprising a pole piece being fixedly coupled to the injection valve housing and an armature being axially movable within the injection valve cavity and operable to displace the valve needle, wherein the pole piece has a first contact surface and the armature has a second contact surface which are directed opposite to each other, wherein one of the two contact surfaces is designed to have a contact angle with a given fluid, which is smaller than 90°, and wherein the other of the two contact surfaces is designed to have a contact angle with the given fluid, which is 90° or larger.

In a further embodiment, the contact surface, which is designed to have a contact angle with the given fluid, which is 90° or larger, comprises small bumps.

In a further embodiment, the bumps have lateral dimensions between 1 μm and 30 μm.

In a further embodiment, the contact surface, which is designed to have a contact angle with the given fluid, which is smaller than 90°, comprises small recesses.

In a further embodiment, the recesses have lateral dimensions between 1 μm and 30 μm.

In a further embodiment, the contact surface, which is designed to have a contact angle with the given fluid, which is smaller than 90°, is comprised by an oxidation coated contact region of the pole piece or the armature, respectively.

In a further embodiment, the contact surface, which is designed to have a contact angle with the given fluid, which is 90° or larger, is comprised by an oxidation coated contact region of the pole piece or the armature, respectively.

In a further embodiment, the contact surface, which is designed to have a contact angle with the given fluid, which is smaller than 90°, is comprised by a coating of the pole piece or the armature, respectively, with a thickness between 10 nm and 1000 nm.

In a further embodiment, the contact surface, which is designed to have a contact angle with the given fluid, which is 90° or larger, is comprised by a coating of the pole piece or the armature, respectively, with a thickness between 10 nm and 1000 nm.

BRIEF DESCRIPTION OF THE DRAWINGS

Exemplary embodiments of the invention are explained below with reference to the drawings, in which.

DETAILED DESCRIPTION

Figure 2:
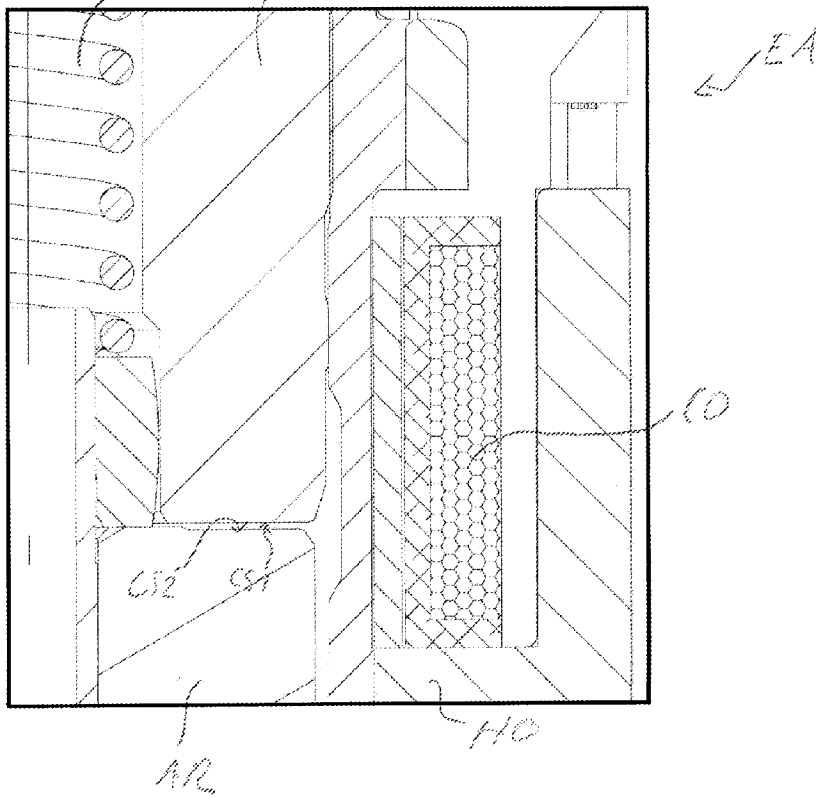

Embodiments of the invention provide an injector which has little wearing.

A fluid injector for a combustion engine, in particular for an internal combustion engine, is specified. The fluid injector has a central longitudinal axis and comprises an injection valve housing with an injection valve cavity. The injector further comprises a valve needle being axially movable within the injection valve cavity. The injector comprises an electromagnetic actuator unit being operable to actuate the valve needle. The electromagnetic actuator unit comprises a pole piece and an armature. The pole piece is fixedly coupled with respect to the injection valve housing or in one piece with the injection valve housing. The armature is axially movable within the injection valve cavity and operable to displace the valve needle axially. The armature may be fixedly mechanically coupled to the valve needle. Alternatively it may axially displaceable with respect to the valve needle, wherein axial displacement of the armature with respect to the valve needle is expediently limited, for example by a retainer integrated in the valve needle of fixed to the valve needle.

The pole piece has a first contact surface and the armature has a second contact surface, which are directed opposite to each other. In other words, the first and second contact surfaces face towards one another. The pole piece may be operable to limit axial displacement of the armature with respect to the injection valve housing by means of mechanical interaction of the first and second contact surfaces, in particular by means of a form-fit engagement of the first and second contact surfaces.

One of the two contact surfaces is designed to have a contact angle with a given fluid, which is smaller than 90° and the other of the two contact surfaces is designed to have a contact angle with the given fluid, which is 90° or larger.

The given fluid is, for example, gasoline or diesel. The contact surface, which is designed to have a contact angle with the given fluid, which is smaller than 90°, can also be called a fluid-philic—e.g gasoline-philic or diesel-philic—contact surface. The contact surface, which is designed to have a contact angle with the given fluid, which is 90° or larger, can also be called a fluid-phobic—e.g gasoline-phobic or diesel-phobic-contact surface.

The contact angle is the angle between the contact surface and a liquid drop of the given fluid. The contact angle is, for example, defined by Young's equation. The smaller the contact angle is the stronger is the effect of the fluid-philic contact surface. The bigger the contact angle is the stronger is the effect of the fluid-phobic contact surface. Therefore the fluid-philic contact surface has, for example, a very small contact angle near 0° and the fluid-phobic contact surface has, for example, a very large contact angle of 120° to 160°.

The fluid-philic contact surface can also have a higher adhesiveness and/or a higher wetting ability and/or a higher surface energy than the fluid-phobic contact surface.

By the fluid-philic attribute a wetting film is created during operation of the injector on the fluid-philic contact surface. The wetting film acts as a damping element, by which wearing is reduced. This effect is increased by the fluid-phobic contact surface, because the fluid is pushed away by the fluid-phobic contact surface in the direction of the fluid-philic contact surface. Due to this pushing effect also a sticking effect between the two contact surfaces can be reduced. Further, because the wetting film reduces wearing and can be used as a distance element between the two contact surfaces, there is no need to use toxic chrome, which is normally used as a distance element and for reducing wearing. Thus a chrome-free injector can be achieved.

According to one embodiment, the contact surface, which is designed to have a contact angle with the given fluid, which is 90° or larger, comprises small bumps. In particular, the contact surface is provided with the fluid-phobic properties by means of the small bumps.

The lateral dimensions of the bumps are, for example, in a range between 1 μm and 30 μm, in particular between 5 μm and 20 μm, where the limits are included in each case. The height of the bumps may be in the same ranges. In another embodiment, the height of the bumps is in a range between 10 nm and 1000 nm, the limits being included. The small bumps have, for example, a diameter of about 10 μm. The small bumps are, for example, produced by laser scattering. With such small bumps and/or pins very high contact angles can be achieved.

According to a further embodiment, the contact surface, which is designed to have a contact angle with the given fluid, which is smaller than 90°, comprises small recesses. In particular, the contact surface is provided with the fluid-philic properties by means of the small recesses.

The lateral dimensions of the recesses are, for example, in a range between 1 μm and 30 μm, in particular between 5 μm and 20 μm, where the limits are included in each case. The depth of the recesses may be in the same ranges. In another embodiment, the depth of the recesses is in a range between 10 nm and 1000 nm, the limits being included. The small recesses have, for example, a diameter of 10 μm. The small recesses are, for example, made by laser scattering. With such small recesses very small contact angles can be achieved.

According to a further embodiment, the contact surface, which is designed to have a contact angle with the given fluid, which is smaller than 90°, is comprised by an oxidation coated contact region of the armature or the pole piece, respectively.

The oxidation coating is, for example, made by plasma ionization. With the oxidation coating a number of functional polar regions of the surface can be increased or decreased. This results in a modified surface energy of the contact surface. With this feature very small contact angles can be achieved.

According to a further embodiment, the contact surface, which is designed to have a contact angle with the given fluid, which is 90° or larger, is comprised by an oxidation coated contact region of the armature or the pole piece, respectively.

The oxidation coating of the contact region is, for example, made by plasma ionization. With the oxidation coating a number of functional polar regions of the surface can be increased or decreased. This results in a modified surface energy of the contact surface. With this feature very large contact angles can be achieved.

Methods for modifying the surface energy by means of oxidation coating to achieve fluid-philic or fluid-phobic properties, respectively, are in principle known to the skilled person and, therefore, are not explained in further detail here.

According to a further embodiment, the contact surface, which is designed to have a contact angle with the given fluid, which is smaller than 90°, is comprised by a coating of the pole piece or the armature, respectively, with a thickness between 10 nm and 1000 nm.

By this kind of nano-coating with a suitable material, for example PTFE, very small contact angles can be achieved with a particularly thin coating film.

According to a further embodiment, the contact surface, which is designed to have a contact angle with the given fluid, which is 90° or larger, is comprised by a coating of the pole piece or the armature, respectively, with a thickness between 10 nm and 1000 nm.

By this kind of nano-coating with a suitable material, for example PTFE, very large contact angles can be achieved with a particularly thin coating film.

In one embodiment, the bumps and/or recesses may be comprised by the respective coating.

Figure 1:
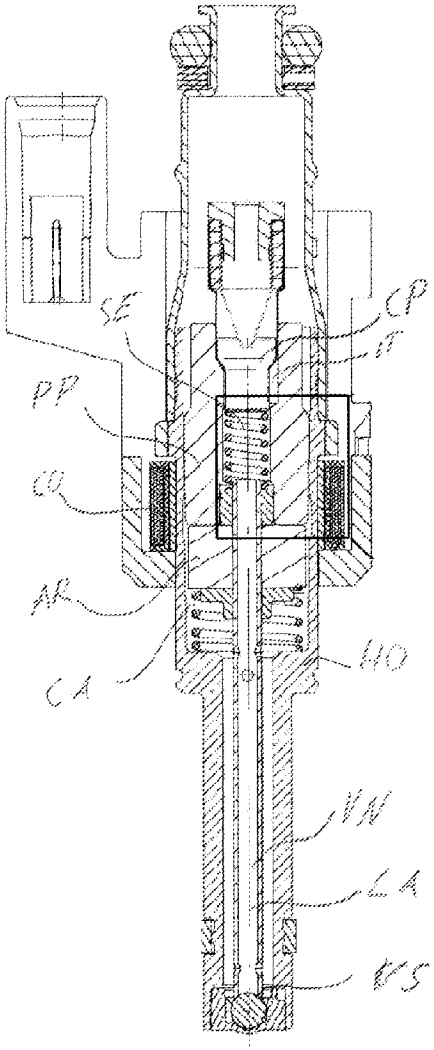
FIG. 1 a fluid injector according to an exemplary embodiment in a longitudinal section view, FIG. 2 an enlarged section of an electromagnetic actuator unit of the injector, FIG. 3 an example of contact angles, and FIG. 4 an enlarged view of two contact surfaces of the injector.

FIG. 1 shows a fluid injector 1 that is particularly suitable for dosing fuel to an internal combustion engine. The fluid injector 1 may be provided for dosing the fuel into an intake manifold of the internal combustion engine or, preferably, for dosing the fuel directly into a combustion chamber of the internal combustion engine.

The injector 1 has a central longitudinal axis LA and an injection valve housing HO with an injection valve cavity CA. The injection valve cavity CA extends along the longitudinal axis LA from a fluid inlet portion to a fluid outlet portion and hydraulically couples a fluid inlet to a fluid outlet of the injector 1.

The injection valve cavity CA takes in a valve needle VN. The valve needle VN is axially movable within the injection valve cavity CA with respect to the injection valve housing HO. The injector 1 further comprises a valve seat VS, on which the valve needle VN rests in a closed position and from which the valve needle VN is axially displaced towards an open position for dispensing fluid from the injector 1.

The injector 1 further comprises a spring element SE being designed and arranged to exert a force on the valve needle VN acting to urge the valve needle VN in a closed position. In the closed position of the valve needle VN, the valve needle VN sealingly rests on the valve seat VS, by this preventing fluid flow through at least one injection nozzle which is in particular comprised by the valve seat VS and represents the fluid outlet of the injector 1. The injection nozzle may be, for example, an injection hole. However, it may also be of some other type suitable for dosing fluid.

The injector 1 further comprises an inlet tube IT in which a component CP is arranged. The component CP forms a seat for the spring element SE. During a manufacturing process of the injector 1, the component CP can be axially moved in the inlet tube IT in order to adjust the force of the spring element SE in a desired manner.

The injector 1 further comprises an electromagnetic actuator unit EA, which is being designed to actuate the valve needle VN. The electromagnetic actuator unit EA, which is shown in FIG. 2, comprises a coil CO. It further comprises a pole piece PP which is fixedly coupled with respect to the injection valve housing HO. The electromagnetic actuator unit EA further comprises an armature AR which is axially movable within the injection valve cavity CA and operable to displace the valve needle VN axially away from the closed position towards the open position. The armature AR may be fixedly mechanically coupled to the valve needle VN or even in one piece with the valve needle VN. In the present embodiment, it is axially displaceable with respect to the valve needle VN, wherein axial displacement of the armature AR with respect to the valve needle VN in the direction away from the valve seat VS is limited by a retainer which is fixed to the valve needle VN. The retainer is also operable to guide the valve needle VN in axial direction by means of mechanical interaction with the pole piece PP. The armature AR is operable to take the valve needle VN with it in direction away from the closed position by means of mechanical interaction via the retainer. In the direction towards the valve seat VS, axial displacement of the armature AR with respect to the valve needle VN is limited by means of a disc element which is fixed to the valve needle VN.

The pole piece PP has a first contact surface CS1 and the armature AR has a second contact surface CS2. The first and the second contact surface CS1, CS2 are directed opposite to each other, i.e. the first and second surfaces CS1, CS2 face towards each other. The pole piece PP is operable to limit axial displacement of the armature AR with respect to the injection valve housing HO by means of interaction of the first and second contact surfaces CS1, CS2, in particular—and disregarding a possible fluid film remaining between the two contact surfaces CS1, CS2 when the fluid injector 1 is in operation—by means of a form-fit engagement of the first and second contact surfaces CS1, CS2. One of the two contact surfaces CS1, CS2 is designed to have a contact angle θ with a given fluid, which is smaller than 90°. The other of the two contact surfaces CS1, CS2 is designed to have a contact angle θ with the given fluid, which is 90° or larger. The second contact surface CS2 of the armature AR can, for example be arranged on a step.

Figure 3:
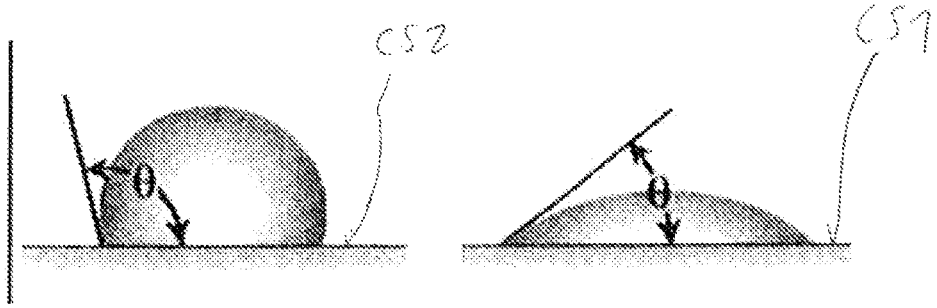

The contact angle θ is exemplary shown in FIG. 3. The contact angle θ is the angle between a surface and a liquid drop of a given fluid. The contact angle θ is, for example, defined by Young's equation. In FIG. 3 the contact angle θ of the second contact surface CS2 is larger than 90°, thus the contact surface CS2 is fluid-phobic. The contact angle θ of contact surface CS1 is smaller than 90°, thus the contact surface CS1 is fluid-philic. The fluid is, for example, gasoline or diesel.

In the following the function of the injector 1 is described in detail:

The fluid is led from the fluid inlet portion towards the fluid outlet portion through the injection valve cavity CA.

The valve needle VN prevents a fluid flow through the fluid outlet and out of the injection valve housing HO in the closed position of the valve needle VN. Outside of the closed position of the valve needle VN, the valve needle VN unseals the injection nozzle to enable the fluid flow through the fuel outlet.

In case that the electromagnetic actuator unit EA with the coil CO gets energized, the electromagnetic actuator unit EA may effect an electromagnetic force on the armature AR. The armature AR may move in a direction away from the fuel outlet portion, in particular upstream of a fluid flow, due to the electromagnetic force acting on the armature AR. Due to the mechanical coupling with the valve needle VN, the armature AR may take the valve needle VN with it, such that the valve needle VN moves in axial direction out of the closed position. Outside of the closed position of the valve needle VN a gap between the valve seat VS and the valve needle VN at an axial end of the valve needle VN facing away from the electromagnetic actuator unit EA forms a fluid path and fluid can pass through the injection nozzle.

Figure 4:
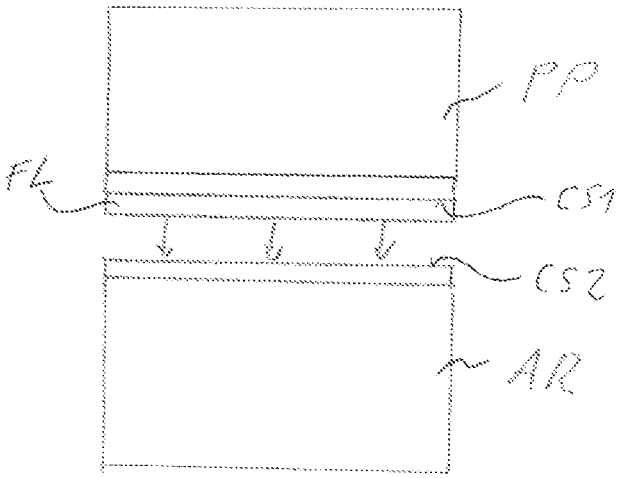

In case that the electromagnetic actuator unit EA gets energized, the contact surface CS1 of the pole piece PP could get in contact with the contact surface CS2 of the armature AR. Due to the fact that one of the contact surfaces CS1, CS2 is fluid-philic and the other is fluid-phobic, a wetting film FL (see FIG. 4) is generated, which causes a damping effect. In this way, a sticking effect of the injector 1 can be reduced so that in particular an advantageously short closing transient of the injector is achievable. Also, the risk of degradation of the injector due to wearing at the first and second contact surfaces CS1, CS2, is reduced. In this way, changes of the injector behavior over its lifetime may be particularly small.

The force balance between the force on the valve needle VN caused by the electromagnetic actuator unit EA with the coil CO and the force on the valve needle VN caused by the spring element SE is chosen in such fasion that the spring element SE may force the valve needle VN to move in axial direction in its closed position when the electromagnetic actuator unit EA is de-energized.

The fluid-philic attribute of one contact surface (CS1, CS2) can, for example, be achieved by a suitable surface structure, for example by small recesses, which, for example, are produced by laser scattering. Alternatively or additionally the fluid-philic attribute can be achieved with an oxidation coating, which is for example produced by plasma ionisation. Alternative or additional the fluid-philic attribute can be achieved with a coating with a suitable material with a thickness between 10 nm and 1000 nm.

The fluid-phobic attribute of one contact surface (CS1, CS2) can, for example, be achieved by a suitable surface structure, for example by small bumps and/or pins, which, for example, are produced by laser scattering. Alternatively or additionally the fluid-phobic attribute can be achieved with an oxidation coating, which is for example produced by plasma ionisation. Alternative or additional the fluid-phobic attribute can be achieved with a coating with a suitable material with a thickness between 10 nm and 1000 nm.

What is claimed is:

1. A fluid injector for a combustion engine burning a given fluid as fuel, the fluid injector comprising:

a central longitudinal axis, an injection valve housing with an injection valve cavity, a valve needle axially movable within the injection valve cavity, an electromagnetic actuator unit operable to actuate the valve needle, the electromagnetic actuator unit comprising a pole piece fixedly coupled to the injection valve housing and an armature axially movable within the injection valve cavity and operable to displace the valve needle, wherein the pole piece has a first contact surface and the armature has a second contact surface opposite the first contact surface of the pole piece, wherein one of the first and second contact surfaces is fluid-philic with a contact angle of less than 90° with the given fluid, and wherein the other of the first and second contact surfaces is fluid-phobic with a contact angle of more than 90° with the given fluid and comprises bumps having lateral dimensions between 1 μm and 30 μm.

2. The injector of claim 1, wherein the fluid-philic contact surface having a contact angle of less than 90° with the given fluid comprises an oxidation coated contact region of the pole piece or the armature.

3. The injector of claim 1, wherein the fluid-philic contact surface having a contact angle of less than 90° with the given fluid comprises a coating of the pole piece or the armature, the coating having a thickness between 10 nm and 1000 nm.

4. A fluid injector for a combustion engine burning a given fluid as fuel, the fluid injector comprising:

a central longitudinal axis, an injection valve housing with an injection valve cavity, a valve needle axially movable within the injection valve cavity, an electromagnetic actuator unit operable to actuate the valve needle, the electromagnetic actuator unit comprising a pole piece fixedly coupled to the injection valve housing and an armature axially movable within the injection valve cavity and operable to displace the valve needle, wherein the pole piece has a first contact surface and the armature has a second contact surface opposite the first contact surface of the pole piece, wherein one of the first and second contact surfaces is fluid-philic with a contact angle of less than 90° with the given fluid and comprises recesses having lateral dimensions between 1 μm and 30 μm, and wherein the other of the first and second contact surfaces is fluid-phobic with a contact angle of more than 90° with the given fluid.

5. The injector of claim 4, wherein the fluid-phobic contact surface having a contact angle of at least 90° with the given fluid comprises an oxidation coated contact region of the pole piece or the armature.

6. The injector of claim 4, wherein the fluid-phobic contact surface having a contact angle of at least 90° with the given fluid comprises a coating of the pole piece or the armature, the coating having a thickness between 10 nm and 1000 nm.

7. An internal combustion engine configured to burn a given fluid as fuel, comprising:

a fluid injector comprising:

a central longitudinal axis, an injection valve housing with an injection valve cavity, a valve needle axially movable within the injection valve cavity, an electromagnetic actuator unit operable to actuate the valve needle, the electromagnetic actuator unit comprising a pole piece fixedly coupled to the injection valve housing and an armature axially movable within the injection valve cavity and operable to displace the valve needle, wherein the pole piece has a first contact surface and the armature has a second contact surface opposite the first contact surface of the pole piece, wherein one of the first and second contact surfaces is fluid-philic with a contact angle of less than 90° with a given fluid, and wherein the other of the first and second contact surfaces is fluid-phobic with a contact angle of at least 90° with the given fluid; and wherein:

at least one of: the fluid-phobic contact surface comprises either bumps with lateral dimension between 1 μm and 30 μm or a coating of the pole piece or the armature, the coating having a thickness between 10 nm and 1000 nm; or the fluid-philic contact surface comprises either recesses with lateral dimensions between 1 μm and 30 μm or a coating of the pole piece or the armature, the coating having a thickness between 10 nm and 1000 nm.

8. The internal combustion engine of claim 7, wherein the fluid-phobic contact surface comprises bumps.

9. The internal combustion engine of claim 8, wherein the bumps have lateral dimensions between 1 μm and 30 μm.

10. The internal combustion engine of claim 7, wherein the fluid-philic contact surface comprises recesses.

11. The internal combustion engine of claim 10, wherein the recesses have lateral dimensions between 1 μm and 30 μm.

12. The internal combustion engine of claim 7, wherein the fluid-philic contact surface comprises an oxidation coated contact region of the pole piece or the armature.

13. The internal combustion engine of claim 7, wherein the fluid-phobic contact surface comprises an oxidation coated contact region of the pole piece or the armature.

14. The internal combustion engine of claim 7, wherein the fluid-philic contact surface comprises a coating of the pole piece or the armature, the coating having a thickness between 10 nm and 1000 nm.

15. The internal combustion engine of claim 7, wherein the fluid-phobic contact surface comprises a coating of the pole piece or the armature, the coating having a thickness between 10 nm and 1000 nm.

16. A fluid injector for a combustion engine burning a given fluid as fuel, the fluid injector comprising:

a central longitudinal axis, an injection valve housing with an injection valve cavity, a valve needle axially movable within the injection valve cavity, an electromagnetic actuator unit operable to actuate the valve needle, the electromagnetic actuator unit comprising a pole piece fixedly coupled to the injection valve housing and an armature axially movable within the injection valve cavity and operable to displace the valve needle, wherein the pole piece has a first contact surface and the armature has a second contact surface opposite the first contact surface of the pole piece, wherein one of the first and second contact surfaces is fluid-philic with a contact angle of less than 90° with the given fluid, wherein the other of the first and second contact surfaces is fluid-phobic with a contact angle of more than 90° with the given fluid, and at least one of the fluid-philic contact surface and the fluid-phobic contact surface comprises a coating of the pole piece or the armature, the coating having a thickness between 10 nm and 1000 nm.

* * * * *